United States Patent [19]

Hewitt, Jr.

[11] 4,045,266

[45] Aug. 30, 1977

[54] PICTURE FRAMING METHOD AND KIT

[76] Inventor: William T. Hewitt, Jr., 107-111 N. Main, Leland, Miss. 38756

[21] Appl. No.: 612,852

[22] Filed: Sept. 12, 1975

[51] Int. Cl.[2] ..... B32B 7/04

[52] U.S. Cl. ..... 156/91; 29/450; 83/467 R; 269/41; 269/295; 269/321 A

[58] Field of Search ..... 269/108, 109, 45, 321 A, 269/295, 41, 303, 315; 156/91; 83/467 R; 29/450

[56] References Cited

U.S. PATENT DOCUMENTS

| | | | |
|---|---|---|---|
| 633,657 | 9/1899 | Muller | 269/108 |
| 683,524 | 10/1901 | Tinkham | 269/295 |
| 1,162,759 | 12/1915 | Ferris | 269/111 |
| 2,147,800 | 2/1939 | Sadowski | 269/321 A |
| 2,415,259 | 2/1947 | Renton | 269/321 A |
| 2,595,500 | 5/1952 | Zimmerman | 269/303 |
| 2,621,807 | 12/1952 | Rendick | 269/321 A |
| 3,224,754 | 12/1965 | Graham | 269/108 |
| 3,531,352 | 9/1970 | Fujii | 156/91 |

*Primary Examiner*—Edward G. Whitby

*Attorney, Agent, or Firm*—Berman, Aisenberg & Platt

[57] ABSTRACT

A kit for forming a picture frame has a board member with a pattern of criss-crossed vertical and horizontal rows of holes into which are inserted pegs or nails in order to form a holding device for the component portions of the picture frame. Rubber bands are provided for retaining the component portions of the picture frame in place after the mitered corners have been glued. The board is also provided with a mat cutting portion comprising a slot in the upper portion of the board and a 45° undercut portion beneath the slot to enable a cutting tool to be maneuvered so as to cut the mat at any angle between 45° and 90°.

8 Claims, 5 Drawing Figures

FIG. 1.
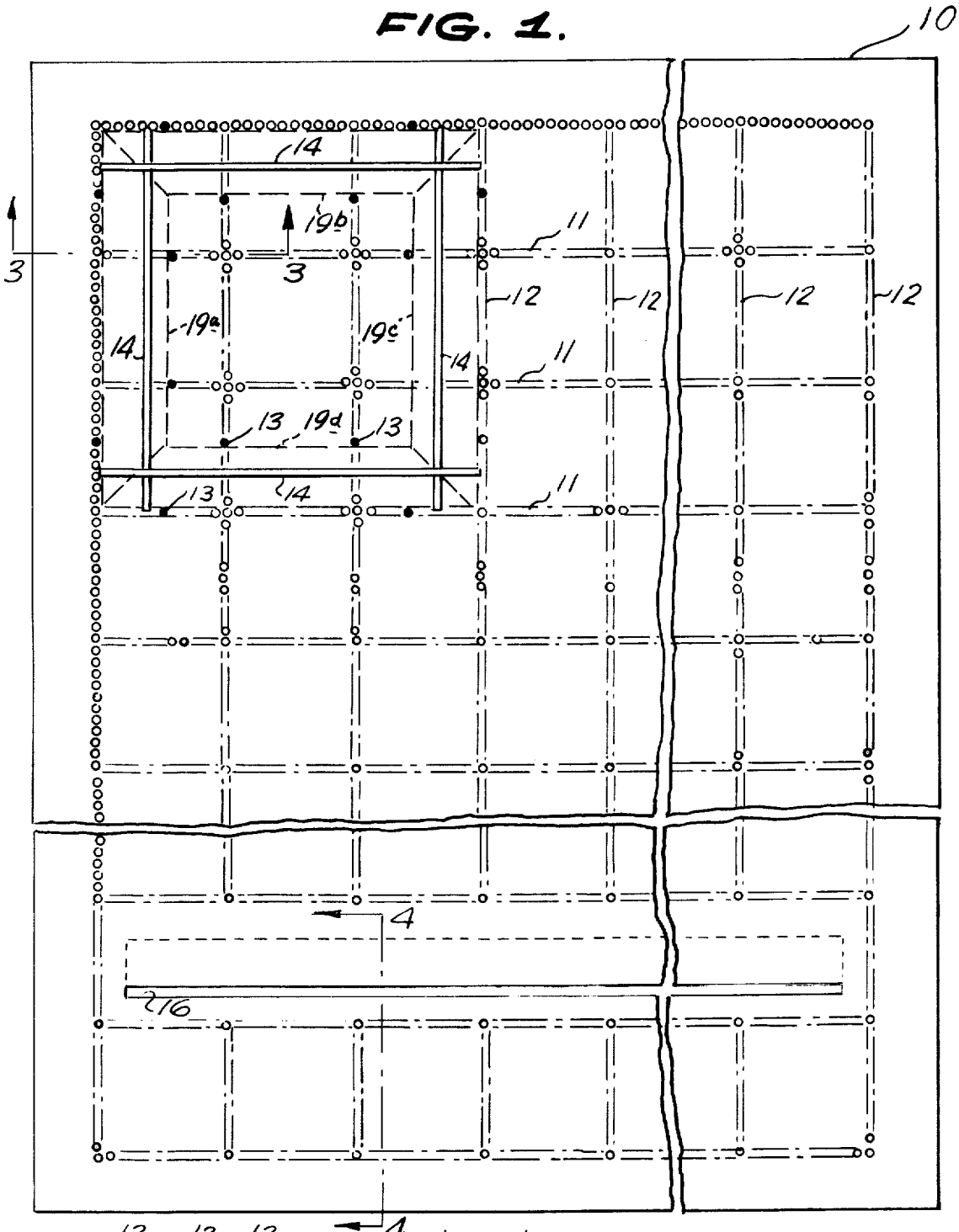
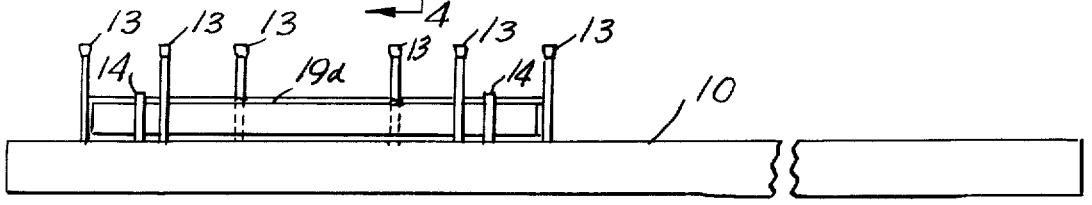
FIG. 2.

PICTURE FRAMING METHOD AND KIT

BACKGROUND OF THE INVENTION

1. Field of the Invention

This invention relates to picture framing and more particularly relates to a kit and method for "do-it-yourself" picture framing.

2. The Prior Art

Despite the fact that picture framing is a widely practiced "do-it-yourself" craft, there is no presently available kit or the like, which will enable one to readily, expeditiously and inexpensively construct a conventional mitered joint picture frame at home. While various attempts have been made to solve this problem, all have been deficient in one or more respects.

Applicant is aware of the following patents which generally relate to this problem:

| | | |
|---|---|---|
| 2,415,259 | Renton | 1947 |
| 3,224,754 | Graham | 1965 |
| 3,493,224 | Graham | 1970 |
| 3,610,612 | Day | 1971 |

OBJECTS AND SUMMARY OF THE INVENTION

It is a principal object of the present invention to provide an improved method and apparatus for picture framing.

A further object of the present invention is to provide an improved do it yourself kit for picture framing.

Still another object of the present invention is to provide a kit for picture framing which enables one with relatively little skill in the picture framing craft to rapidly, inexpensively and accurately assemble a picture frame of the mitered corner type.

A further object of the present invention is to provide a picture framing apparatus which incorporates therein a mat cutting guide.

These and other objects of the present invention are achieved through the provision of a kit consisting essentially of three components. The first of these components is a baseboard having a gridwork of holes disposed in columns and rows and spaced a predetermined distance apart. The second component comprises a plurality of pegs or the like designed to be inserted in the holes and project upwardly therefrom. The third component is a plurality of rubber bands or the like. The baseboard also contains a mat cutting slot and guide. In utilizing the kit of the present invention, the four sides of the rectangular frame are first suitably cut to the proper dimensions with the corners being mitered. The frame segments are then laid on the board along the gridwork of holes and the pegs are positioned on either side of the frame segments and inserted in the appropriate holes to provide a guide for retaining the frame segments in place. Glue is then applied to the mitered corners and the rubber bands are stretched across from side to side of the frame in order to hold the segments in place. The pegs are removed and the corners of the frame may be nailed together at any convenient time. Thus, according to the principle of this invention, an economical framing method is provided whereby 16 × 26 inches or smaller frames may be laid aside overnight after having been glued and secured by rubber bands. The nailing of the mitered corners may then be done at leisure.

BRIEF DESCRIPTION OF THE DRAWINGS

FIG. 1 is a plan view of the frame assembling kit of the present invention showing a frame assembled thereon.

FIG. 2 is a front elevation of the kit in FIG. 1.

DETAILED DESCRIPTION OF A PREFERRED EMBODIMENT

Figure 3:
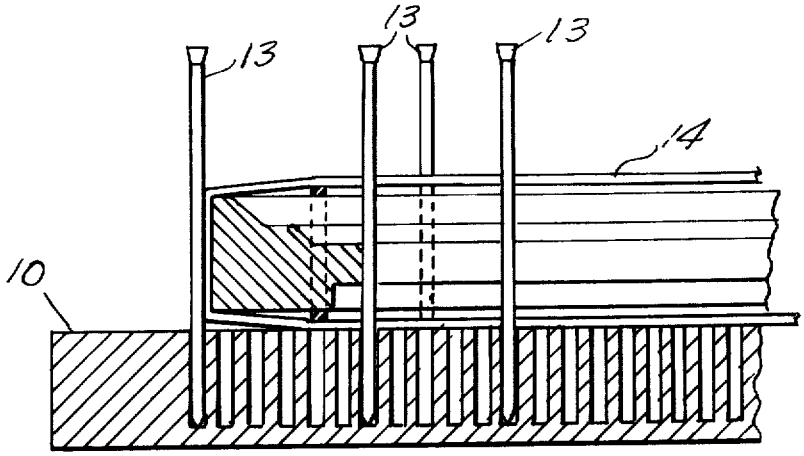
FIG. 3 is a partial section taken on the line 3—3 of FIG. 1 and looking in the direction of the arrows.

Turning now to the various figures of drawings wherein like reference numerals designate like parts throughout, and in particular to FIGS. 1, 2 and 3, there is shown a preferred embodiment of the invention wherein baseboard 10 is provided with a plurality of intersecting rows of holes 11 and columns of holes 12 so as to form a gridwork thereon. In a preferred embodiment, the holes are ⅛ inch apart and ⅜ inch deep at 3/16 inch from center to center along four sides of 2-1/16 inch squares.

As a component of the frame making kit of the present invention, a plurality of pegs 13 are provided, totaling at least 16 in number. As can be seen in FIGS. 1, 2 and 3, when in use, 16 pegs 13 are positioned in holes 11 and 12 so that each of the frame segments 19*a*, 19*b*, 19*c* and 19*d* is held firmly in place. Preferably, 16 pegs 13 are utilized, with four such pegs being employed to hold each frame segment in place. In a preferred embodiment, pegs 13 may take the form of No. 8 finishing nails.

Also furnished with the kit of the present invention are rubber bands 14, or other such resilient bands, which are designed to hold the frame segments 19*a*, 19*b*, 19*c* and 19*d* in place, once they have been assembled on board 10 between pegs 13. Preferably, at least eight such rubber bands are provided, so that, if necessary, four bands 14 may be stretched between each pair of oppositely disposed frame segments 19, in order to hold the assembled frame together, until the corners can be permanently fastened, as will appear more fully hereinbelow. It should be realized that in practice, bands 14 of a variety of sizes and strengths are provided to accommodate varying frame sizes.

Figure 4:
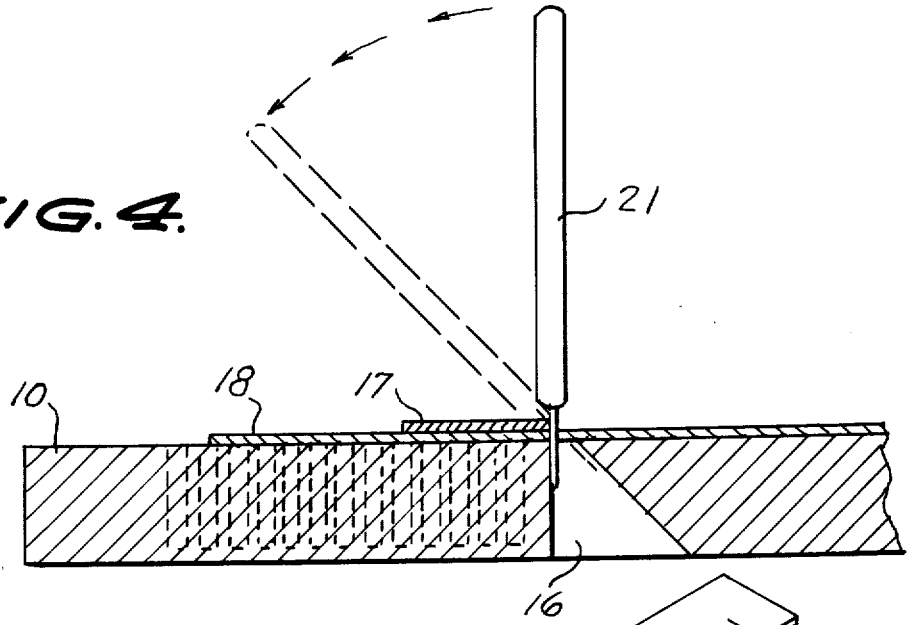
FIG. 4 is a partial section taken on the line 4—4 in FIG. 1 and looking in the direction of the arrows and indicating the manner in which the mat cutting guide of the present invention is utilized.

With specific reference to FIGS. 1 and 4, it can be seen that the baseboard 10 is provided with a slot 16 in its upper surface, beneath which is disposed a 45° undercut. The purpose of this arrangement, as will become more apparent hereinafter, is to enable the user of the kit to cut a mat for the framed picture at any desired angle from 0° to 45°. In a preferred embodiment of the invention, the slot 16 is 3/16 of an inch wide. It should be noted that no holes 11 or 12 are provided in the area where slot 16 is disposed.

In utilizing the frame assembling kit of the present invention, the four frame segments 19*a*, 19*b*, 19*c* and 19*d* are first cut to the appropriate size with mitered corners, in any conventional manner. The inside of the mitered corners may be roughened with a hacksaw blade or the like in order to make the glue hold more firmly. The four frame segments 19*a*, 19*b*, 19*c* and 19*d* are then placed in position on baseboard 10 as shown most clearly in FIG. 1. Sixteen pegs 13 are then positioned in holes 11 and 12 as shown in FIG. 1, in order to hold the frame segments firmly in place. The frame segments are then raised slightly and glue is applied to the mitered corners, the segments then being replaced so that abutting mitered corners are firmly in contact with each other. Rubber bands 14 are then placed over the frame segments to hold them securely in place as shown in FIGS. 1 and 3. Pegs 13 are then removed and the frame is squared up. The four corners of the frame may then be nailed together when desired. At this point, rubber bands 14 may be removed.

Figure 5:
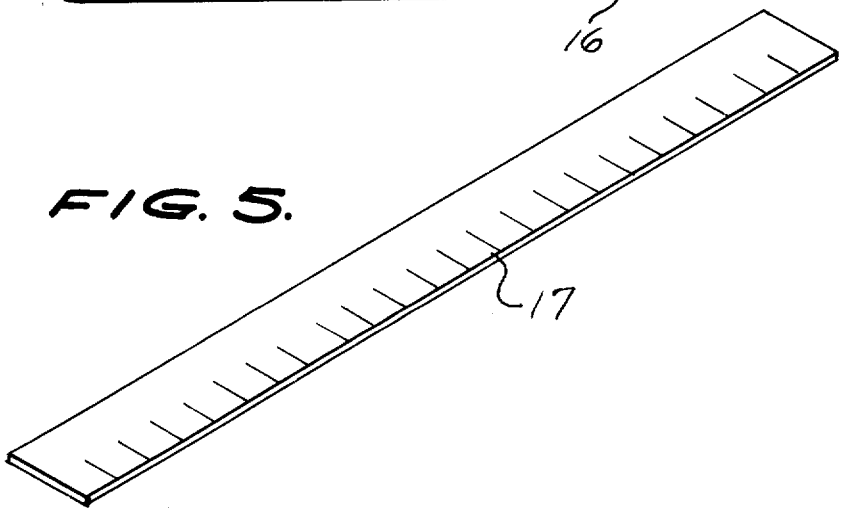
FIG. 5 is a perspective view of a guide ruler employed with the mat cutting guide of the present invention.

In order to form the mat for the framed picture, the mat board is placed over slot 16 and a ruler 17 or other straight edged device, as seen in FIG. 5, is placed over the mat 18 along slot 16, as is seen in FIG. 4. Ruler 17 may then be taped in place so that it will not move during the cutting operation. Cutting tool 21 may then be used to cut the mat to the desired size, using ruler 17 as a guide. As indicated in FIG. 4, cutting tool 21 may be rotated in the direction of the arrows in order to form the mat at any desired angle between 90° and 45°.

While a preferred embodiment of the invention has been described, it will be realized by those skilled in the art that various departures may be made therefrom without violating the spirit and intent of the invention. Accordingly, it is intended that the scope of the invention be defined only by the claims appended hereinbelow.

I claim:

1. A method of assembling a picture frame from a plurality of picture frame segments having mitered corners, comprising:

a. providing a plurality of holes arranged in intersecting parallel rows and parallel columns in a flat board, and spacing said rows from each other and said columns from each other so that two frame segments may be placed between two sets of parallel rows of said holes and two other segments may be placed between two sets of parallel columns of said holes;

b. placing said two segments between said two sets of parallel rows and placing said other two segments between said two sets of parallel columns with the mitered corners of said segments abutting in the desired framing relationship;

c. inserting pegs in selected ones of said holes in said sets of parallel columns and said sets of parallel rows in abutting relationship to the edges of said frame segments and leaving the corners of said assembled frame segments free and unobstructed; and d. applying glue to said abutting corners of said frame segments.

2. The method set forth in claim 1 further including the step of applying resilient retaining means across oppositely disposed segments of said frame, so as to maintain said frame in an assembled condition.

3. The method set forth in claim 2 further including the steps of removing said pegs from said holes and permanently joining abutting frame segments at the corners thereof by inserting fastening means therein.

4. A picture framing kit for joining together a plurality of picture frame segments having mitered corners, comprising:

a. a base board having a plurality of holes therein arranged in intersecting parallel rows and parallel columns, spaced and arranged so that two of said frame segments may be placed between two sets of parallel rows of said holes and two other segments may be placed between two sets of parallel columns of said holes, with the mitered corners of said segments abutting in the desired framing relationship;

b. means for temporarily securing said segments in said desired framing relationship with said frame corners being free and unobstructed, comprising a plurality of pegs insertable in said holes in abutting relationship to the edges of said frame segments disposed between said sets of parallel rows and columns of said holes; and c. a plurality of flexible band means for securing said frame segments in place by passing at least one of said band means around said two segments disposed between said two sets of columns of holes and at least one other of said band means around said two segments disposed between said two sets of rows of holes.

5. The picture framing kit set forth in claim 4 further including slot means extending through said base board for providing a mat cutting guide.

6. The picture framing kit set forth in claim 5 wherein said slot means comprises an undercut portion below the upper surface of said base board having an angular configuration of 45°.

7. A mat cutting guide for picture framing comprising:

a. a substantially flat board;

b. a slot extending through said board;

c. said slot including means for permitting the cutting of a mat at a range of angles, comprising:

i. a widened upper slot portion for permitting the rotation of a cutting instrument; and ii. a wedge shaped opening directly below said upper portion, and communicating therewith, said wedge shaped opening comprising one side perpendicular to the surface of said board and one side disposed at an acute angle to said perpendicular side, said sides terminating at the edges of said widened upper slot portion.

8. The mat cutting guide set forth in claim 7 wherein said acute angle is approximately 45°.

* * * * *